United States Patent [19]

Nelson

[11] 4,125,365

[45] Nov. 14, 1978

[54] ROLL THROUGH BILLET HEATER

[75] Inventor: John W. Nelson, Wyoming, Mich.

[73] Assignee: Oliver Machinery Company, Grand Rapids, Mich.

[21] Appl. No.: 785,516

[22] Filed: Apr. 7, 1977

[51] Int. Cl.[2] ..... F27B 9/04; F27B 9/14

[52] U.S. Cl. ..... 432/152; 432/153; 432/144; 266/87; 432/243; 198/742

[58] Field of Search ..... 432/143–146, 432/152–154, 176, 38, 43, 45, 5, 249, 243; 266/87; 198/742

[56] References Cited

U.S. PATENT DOCUMENTS

| | | | |
|---|---|---|---|
| 2,087,731 | 7/1937 | Klouman | 432/249 |
| 2,669,068 | 2/1954 | Wambreuze | 432/152 |
| 3,301,374 | 1/1967 | Proctor | 198/742 |
| 3,304,071 | 2/1967 | Gentry | 432/168 |
| 3,473,645 | 10/1969 | Kidd | 198/742 |
| 3,539,100 | 11/1970 | Scanlon et al. | 432/38 |
| 3,713,631 | 1/1973 | Enk et al. | 432/243 |
| 3,779,696 | 12/1973 | Poore et al. | 432/5 |
| 3,854,865 | 12/1974 | Fay | 432/146 |
| 3,869,040 | 3/1975 | Rice | 198/219 |
| 4,012,190 | 3/1977 | Dicks et al. | 432/146 |
| 4,050,200 | 10/1977 | Bartos | 198/774 |

FOREIGN PATENT DOCUMENTS

| | | | |
|---|---|---|---|
| 1,451,889 | 10/1976 | United Kingdom | 198/472 |

*Primary Examiner*—Henry C. Yuen

*Attorney, Agent, or Firm*—Price, Heneveld, Huizenga & Cooper

[57] ABSTRACT

An apparatus for heating billets and the like prior to hot extrusion is disclosed. The apparatus includes an elongated, insulated tunnel having an inlet opening and an outlet opening. A conveyor extends through the tunnel from the inlet to the outlet and conveys a plurality of equally spaced, transversely arranged billets in a step-like manner. The conveyor rotates the billets as they are conveyed through the tunnel. A source of high temperature air is connected to a plenum positioned above the conveyor. High temperature air is discharged from the plenum through a plurality of slot-like jets positioned above the billets so that the air directly impinges on the billets. Temperature probes are included for insuring that the billets are biased to one side of the conveyor upon discharge and for sensing the billet temperature to control the air temperature within the tunnel. An unloader is provided for receiving the billets discharged from the tunnel and rotating them through an angle of 90° and to a position for transfer to an extrusion press.

22 Claims, 20 Drawing Figures

ROLL THROUGH BILLET HEATER

BACKGROUND OF THE INVENTION

This invention relates to apparatus for heating aluminum billets and the like to a temperature suitable for hot extrusion in a press.

In typical aluminum or other metal hot extrusion processes, metal billets of cylindrical shape are heated to a temperature suitable for extrusion. The preheated, cylindrical billet is then shaped into the desired form by forcing it through or squeezing it through a die under pressure. With aluminum processes, the billet is typically heated to a temperature of approximately 850° F. prior to extrusion.

Various proposals have been made for furnaces or heating apparatus capable of preheating billets. For example, induction furnaces and direct flame impingement gas or oil furnaces have been employed. While serving to heat the billets to the desired temperature, these types of furnaces have been relatively inefficient from both a thermal energy standpoint and from a production standpoint. With gas and oil fired, direct or indirect impingement furnaces, heat is lost in the exhaust. Further, thermal inefficiency is reduced by the need for combustion air makeup. Also, with prior billet heaters or furnaces, additional energy losses have been encountered by heat conduction out of the furnace as a result of substantial use of through metal in the furnace designs. For example, prior billet heaters have employed a chain type conveyor and the like for passing the billets through the tunnel of the furnace with their longitudinal axes parallel to the direction of billet movement. These types of conveyors which extend through the exit opening of the furnace, provide substantial quantities of through metal for conduction of heat. Further, these types of conveyors prevent closing off of the exit opening with an insulated door structure. Such prior billet heaters or furnaces have also suffered from the need for large floor space requirements. This is due primarily to the fact that the billets are transferred through the furnace with their longitudinal axes parallel to the long axis of the furnace.

An example of one prior billet heater which solves some of the aforementioned problems may be found in commonly owned U.S. Pat. No. 3,994,678 entitled HEATER FOR BILLETS and issued on Nov. 30, 1976 to the present inventor. The heater disclosed in this patent includes an insulated tunnel structure and billet conveyor means transferring the billets through the various zones of the heater in tandem arrangement with their long axes extending parallel to the direction of travel. Each zone of the heater includes inner and outer chambers with the outer chamber supplied with high temperature gas at a pressure in excess of that of the inner chamber. The chambers are separated by baffles defining narrow slot-like aspirating throats through which secondary gases from a secondary source of air are jetted after entraining high temperature gases from the primary or outer chamber. The apparatus disclosed in this patent may be operated as a closed, recirculating type furnace using an electric heat source. The apparatus therefore represents a substantial improvement over prior devices through increased thermal efficiency.

SUMMARY OF THE INVENTION

In accordance with the present invention, a billet heater is provided which possesses substantially increased thermal efficiency over prior heaters, obtains relatively high heat transfer rates and substantially uniform heating of the billets and further increased production rates through increased billet density within the furnace permitting a reduction in the length of the furnace and high production rates for the floor area occupied. Essentially, the unique billet heater includes an elongated, insulated tunnel and a conveyor means extending through the tunnel from an inlet to an outlet. The conveyor means transfers a plurality of billets through the furnace in a step-like fashion with the billets in a side-by-side arrangement with their long axes extending transverse to the direction of billet travel through the tunnel. A plenum is positioned above the conveyor means and defines a plurality of equally spaced, elongated jets. A source of high temperature, pressurized air communicates with the plenum thereby delivering high temperature air to the jets for direct impingement on the billets. The conveyor means includes provision for rotating the billets as they are transferred through the furnace permitting the jet stream to cover the entire surface of the billets and insuring maximum temperature uniformity.

In narrower aspects of the invention, the apparatus includes temperature sensing probes for sensing the temperature of the billets to thereby control the operation of the heater and also for biasing the billets to one side of the conveyor for proper loading into an extrusion press. Further, a billet unloader is provided which receives the billets at a discharge end of the furnace and rotates the billets through an angle of 90° to deliver them to an extrusion press with their long axes extending parallel to the direction of billet movement through the furnace.

The apparatus in accordance with the present invention results in substantially increased thermal efficiency over prior billet heaters, substantially increased production rates per floor area occupied by the heater as well as substantially uniform heating of the billets within the apparatus.

DETAILED DESCRIPTION OF THE PREFERRED EMBODIMENT

Figure 1:
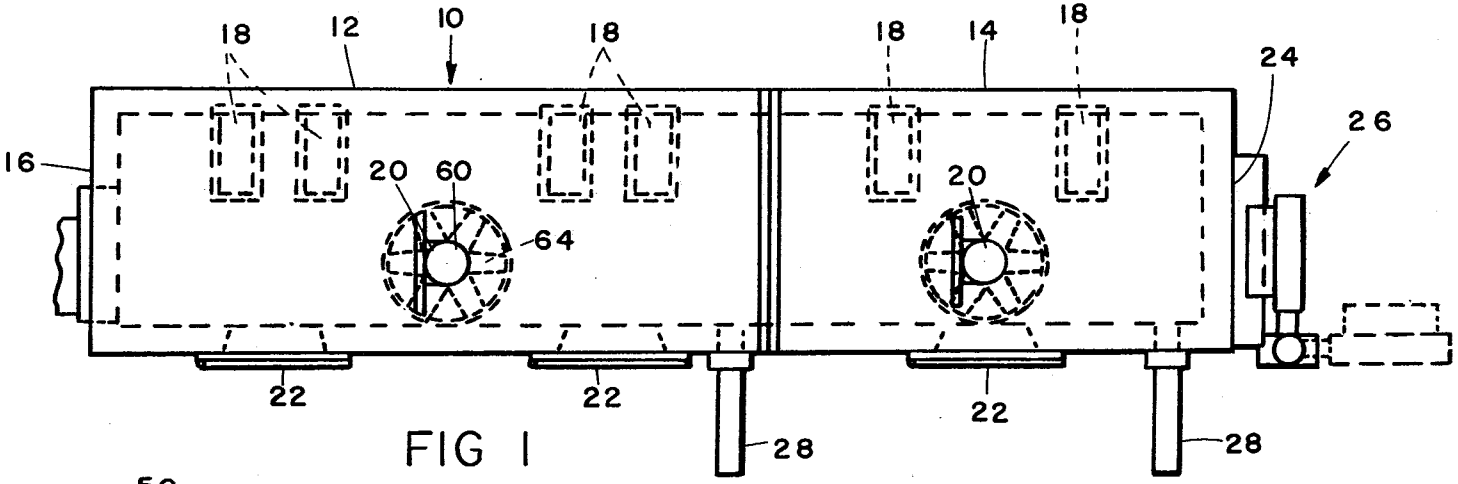
FIG. 1 is a top, plan view of the apparatus in accordance with the present invention.
Figure 8:
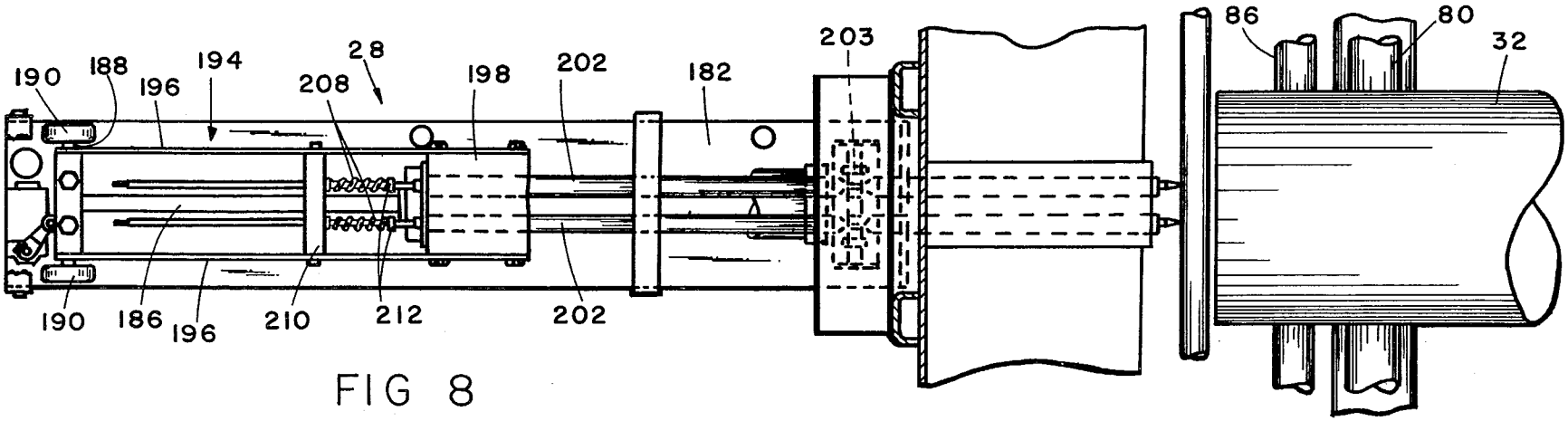
FIG. 8 is an enlarged, fragmentary, plan view showing the unique temperature probe and billet biasing means incorporated in the present invention.
Figure 9:
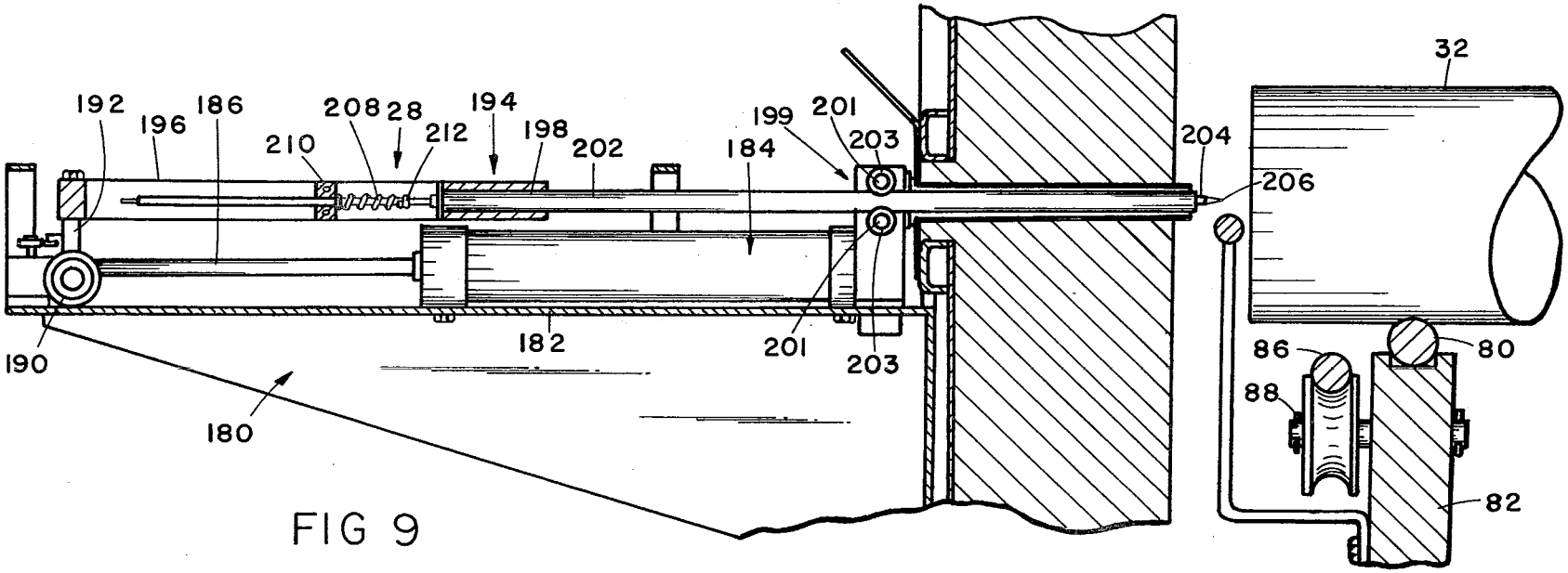
FIG. 9 is an enlarged, side elevational view of the temperature probe and billet biasing means of FIG. 8.

The preferred embodiment of the billet heater in accordance with the present invention is illustrated in the drawings and generally designated 10. As shown in FIG. 1, the billet heater is preferably made in two sections 12 and 14. Although fabricated in two sections, the billet heater defines one continuous heating zone. Section 12 which is the longer of the two sections includes an inlet end 16, a plurality of electrical heating elements 18 and a top mounted fan unit 20. A pair of front access doors 22 are provided to permit ready access to the interior of the heater. The second or shorter section 14 similarly includes heating elements 18, a top mounted fan unit 20 and an access door 22. Section 14 defines a discharge end or outlet opening 24 at which is positioned a billet unloader 26. Temperature probes 28 are positioned adjacent the exit ends of each section 12, 14. These temperature probes 28, as more fully described below, in connection with FIGS. 8 and 9, provide constant control of the heating elements and hence the temperature within the billet heater and also control the discharge of a billet to insure that it is discharged only when at the proper extrusion temperature.

Figure 2:
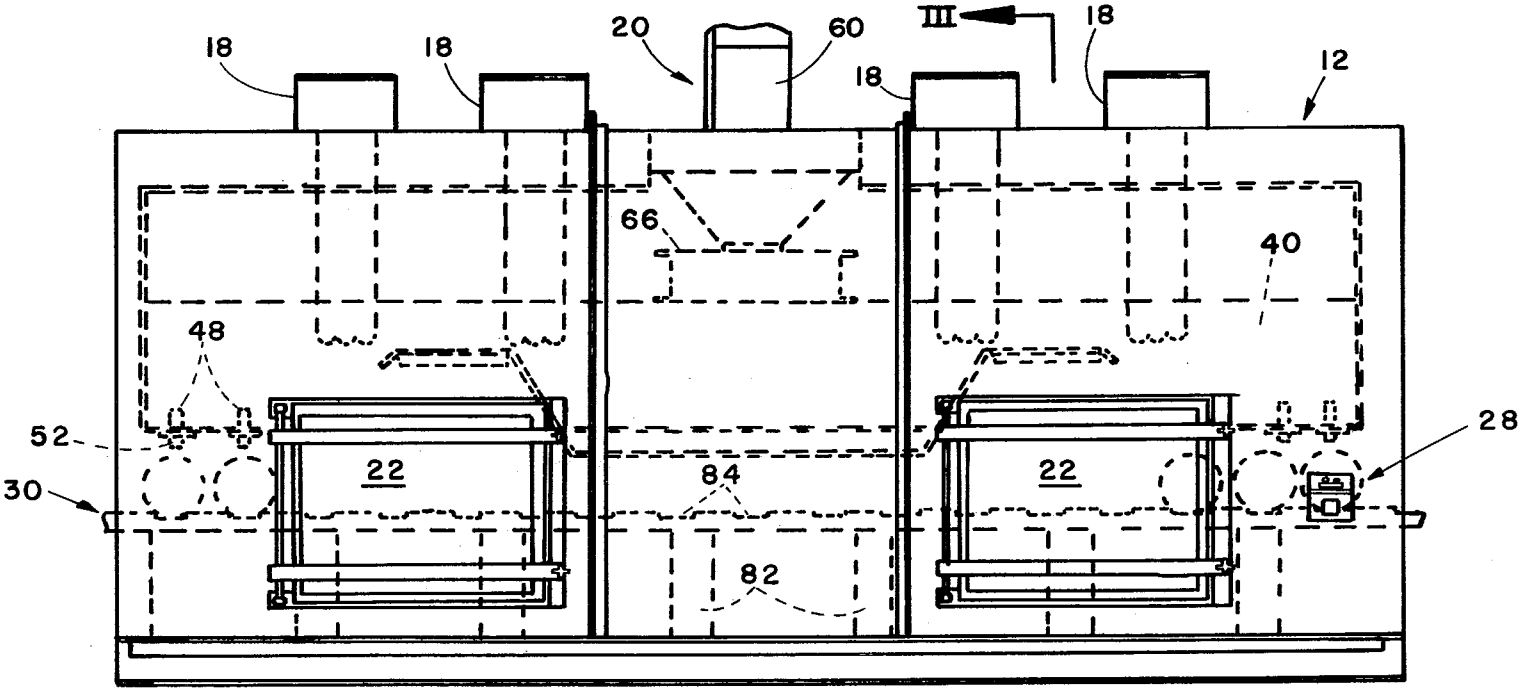
FIG. 2 is a front, elevational view of one section of the apparatus in accordance with the present invention.
Figure 3:
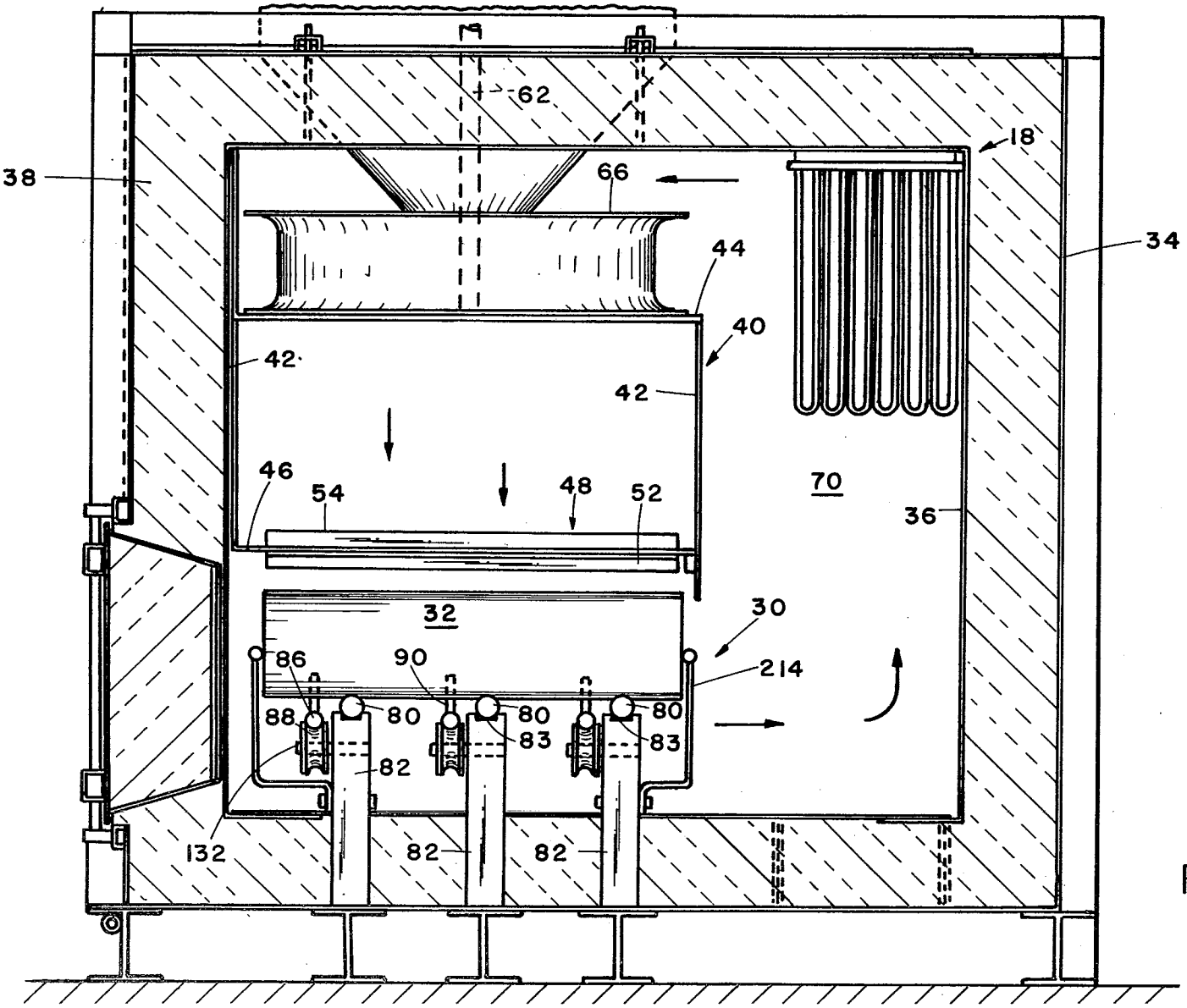
FIG. 3 is an enlarged, cross-sectional view taken generally along line III—III of FIG. 2.

As best seen in FIGS. 2 and 3, billets 32 are transferred through the sections of the billet heater in a step-like fashion on a billet conveyor means generally designated 30. The billets 32 are supported on the billet conveyor means 30 in an equally spaced manner with their longitudinal axes or centerlines extending transversely to the heater and to the direction of billet movement. As a result, the billet density within the heater is substantially increased over that obtained with conventional conveyors. This results is substantial increases in production rates per floor area occupied for the heater. The floor space required may be decreased by decreasing the size of the heater or the total production rate may be increased.

The sections 12, 14 of the heater define an elongated, insulated tunnel. The tunnel includes an airtight outer shell 34 and an inner shell 36 (FIG. 3). The space between the inner and outer shells is filled with a rigid high density insulation 38. It is preferred that the outer and inner shells be substantially airtight so as to minimize heat losses. Supported within the tunnel and extending the length of each section is a plenum 40. As best seen in FIGS. 2 and 3, the plenum 40 is generally rectangular in shape including sides 42, a top 44 and a bottom or floor 46. The plenum 40 is positioned above the billets 32 supported on the billet conveyor 30.

Figure 19:
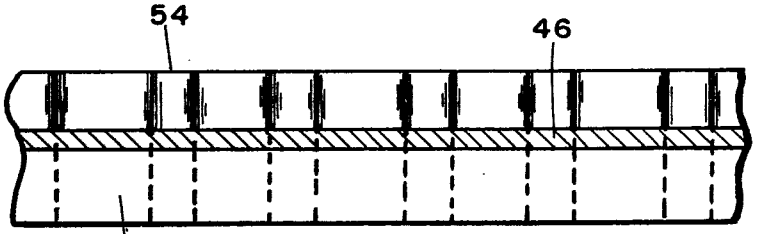
FIG. 19 is a fragmentary, cross-sectional view taken generally along line XIX—XIX of FIG. 18.
Figure 18:
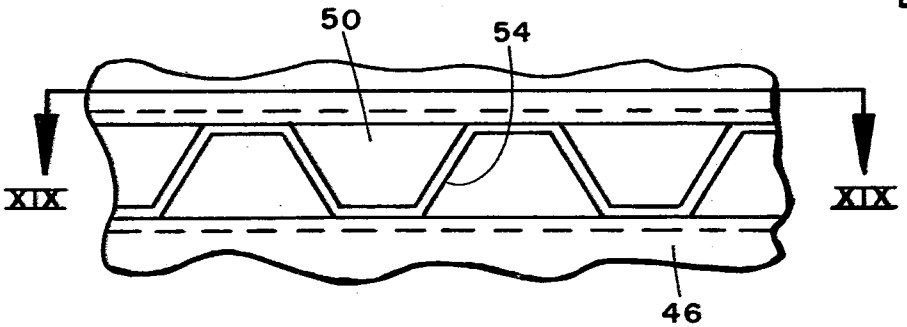
FIG. 18 is a fragmentary, plan view of the air jets defined by the plenum of the heater in accordance with the present invention.

A plurality of elongated, transversely extending, parallel slot-like jets 48 extend through the floor 46 of the plenum 40. One jet is disposed directly above each of the billets supported on the billet conveyor 30. Only a few of the jets 48 have been illustrated in FIG. 2. As seen in FIGS. 3, 18 and 19, each jet 48 is an elongated slot 50 defined by the floor 46 of the plenum. The slot is defined by down turned flanges 52. An air foil deflector 54 is positioned within each of the slots to insure that the air flow through the slots is directly down and onto the billets 32.

Each air flow deflector 54 (FIGS. 18 and 19) includes a plurality of generally flattened, U-shaped sections formed integral with each other in a generally ribbon-like fashion. It is preferred, that the air flow deflector 54 extend from the lower edge of the down turned flanges 52 to a point above the floor 46 of the plenum.

The fan unit 20, as shown, is preferably mounted on the top of the outer shell. The fan unit 20 (FIGS. 2 and 3) includes a motor 60 having an output shaft 62 (FIG. 3). The output shaft 62 drives an axial flow fan type blade assembly 64 (FIG. 1) positioned within a shroud 66. The shroud 66 is mounted at an aperture formed in the top wall 44 of the plenum 40. As seen in FIGS. 1 and 2, it is preferably positioned centrally of the plenum 40.

High temperature air is continuously recirculated within the tunnel by fan unit 20. The inner shell 36 and the exterior of the plenum 40 define a return duct 70 (FIG. 3). Air within the tunnel is drawn up past the heating elements 18 into the intake of the fan blades 66 and discharged into the plenum 40. The high temperature pressurized air within the plenum 40 then discharges downwardly through the air jet slots 48 and impinges directly on the billets 32 positioned below the jets. The high temperature air then flows under and around the billets and the billet conveyor 30, back up past the heating elements 18 to be recycled or recirculated into the plenum 40. It is preferred that electrical elements 18 be employed as the heat source for the billet heater. With such electrical heating elements, the air may be continuously recycled and substantial increases in thermal efficiency are obtained. If gas or oil sources are employed thermal energy is lost through the exhaust and also efficiency is decreased by the need to supply make-up oxygen.

BILLET CONVEYOR

Figure 4:
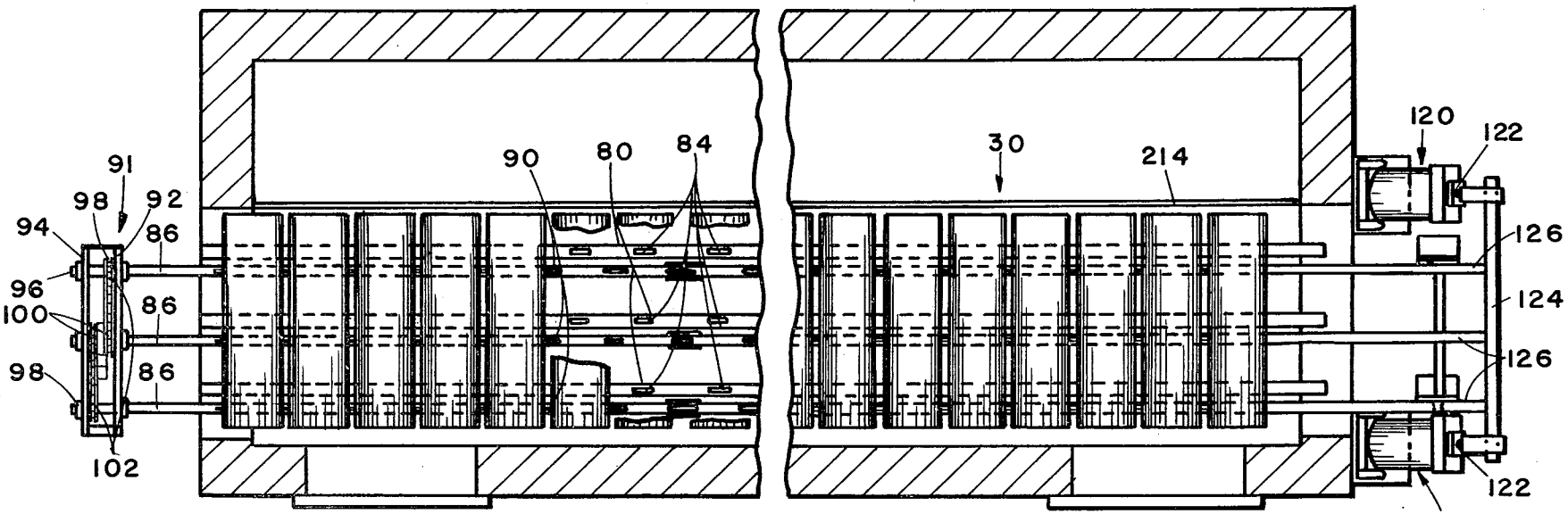
FIG. 4 is a fragmentary, cross-sectional, plan view of the billet heater in accordance with the present invention showing the conveyor means.
Figure 5:
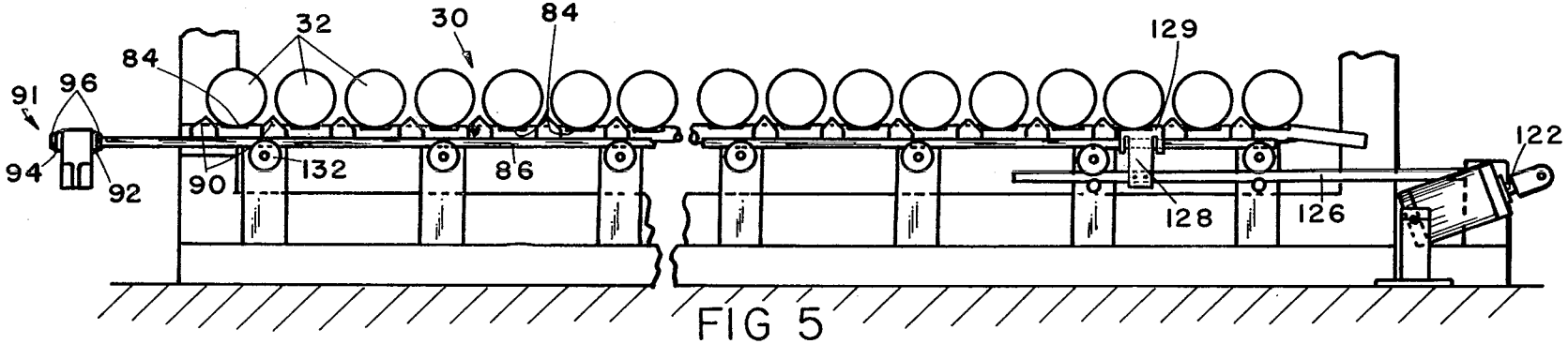
FIG. 5 is a fragmentary, side elevational view of the billet heater showing the conveyor means.

As seen in FIGS. 3, 4 and 5, the billet conveyor includes a plurality of spaced, parallel, longitudinally extending support rails or bars 80. Each support rail 80 is preferably of cylindrical configuration and is supported within the tunnel by rectangular support members 82 having notches 83 formed in the top surface thereof. As seen in FIGS. 4 and 5, the support rails 80 are fabricated with upwardly opening, centering or locating notches 84. The locating notches 84 are positioned at equally spaced intervals along the support rails 80. The spacing between the notches 84 is set so that the billets 32 are centered on the support rails at equally spaced distances and perpendicular thereto. Since billets are typically supplied with diameters within the range of 6 to 9 inches, a 10 inch spacing between the centers of the notches has been found to be acceptable. Also, the locating notches 84 are positioned immediately below an associated slot 48 defined by the plenum so that the high temperature air impinges directly on the top of the billet.

Provision is made for shifting the billets 32 on the support bars 80 in a step-like fashion to convey them through the billet heater. The shifting means preferably takes the form of a plurality of pusher bars 86 supported on wheels or pulleys 88 and extend adjacent and parallel to each of the support rods 80 (FIG. 3). Each rod 86 is provided with equally spaced, radially extending pusher lugs 90. The lugs 90 extend in the same direction and in the same radial plane. The spacing between the pusher lugs 90 is selected so that the lugs may extend upwardly between adjacent billets 32. The lugs, as seen in FIG. 5, are of generally triangular shape and are plate-like. The pusher bars 86 are preferably cylindrical in cross section and are supported for both reciprocating motion and for rotary motion within the tunnel. The bars may be rotated from a first position as shown in FIG. 3 wherein the lugs extend vertically upwardly or perpendicular to the longitudinal axes of the billets to a second position through an angle of 90° where the lugs 90 are positioned below the billets 32 and the notches 84 of the support bars 80.

Figure 10:
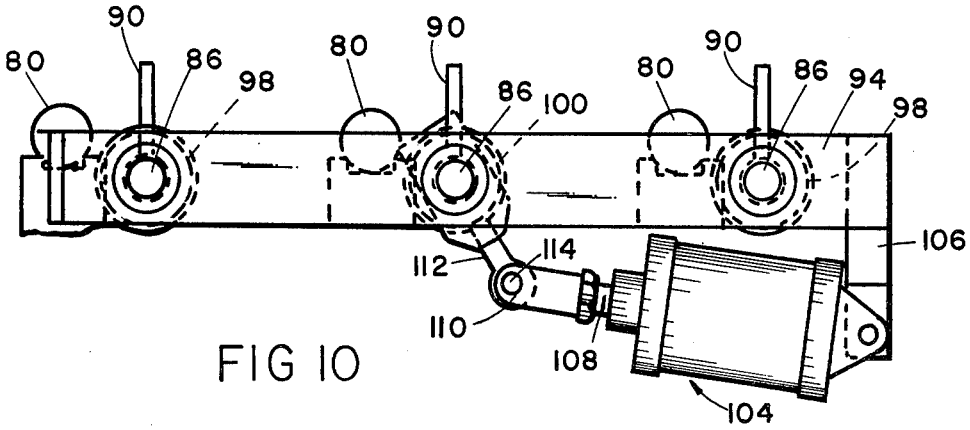
FIG. 10 is a fragmentary, end elevational view of a portion of the billet conveyor in accordance with the present invention.

A bar rotating means 91 (FIGS. 4 and 10) includes a pair of spaced, parallel plates 92, 94 having suitable bearing assemblies 96 through which the rods 86 extend. The outer ones of the rods 86 are provided with gears 98 and the middle of intermediate one of the rods 86 is provided with a pair of gears 100. The gears are connected by suitable flexible transmission means such as chains 102 (FIG. 4). As seen in FIG. 10, a piston/cylinder actuator 104 is supported by a bracket 106 from plate 94. The rod 108 of the piston/cylinder assembly 106 is connected to the center one of the pusher bars 86 through a yoke 110 and a link 112. One end of the link 112 is pivoted to the yoke 110 by a pivot pin 114. The other end of the yoke is non-rotatably secured to the center one of the bars 86. Since all of the bars are ganged together through the gears 98, 100 and the chains 102, actuation of the piston/cylinder actuator 104 causing rotation of the center one of the bars 86 will result in rotation of the remaining bars 86.

Figure 7:
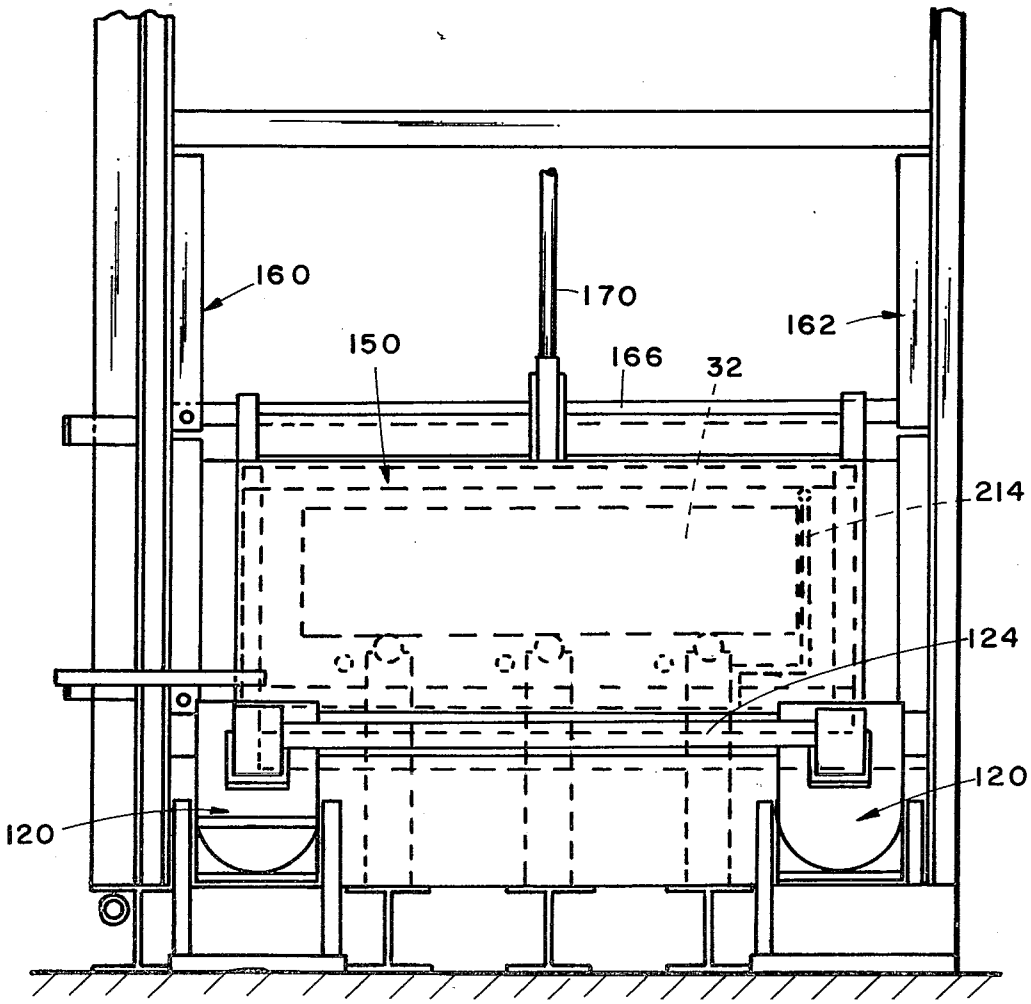
FIG. 7 is an enlarged, end elevational view showing the discharge end of the billet heater.
Figure 6:
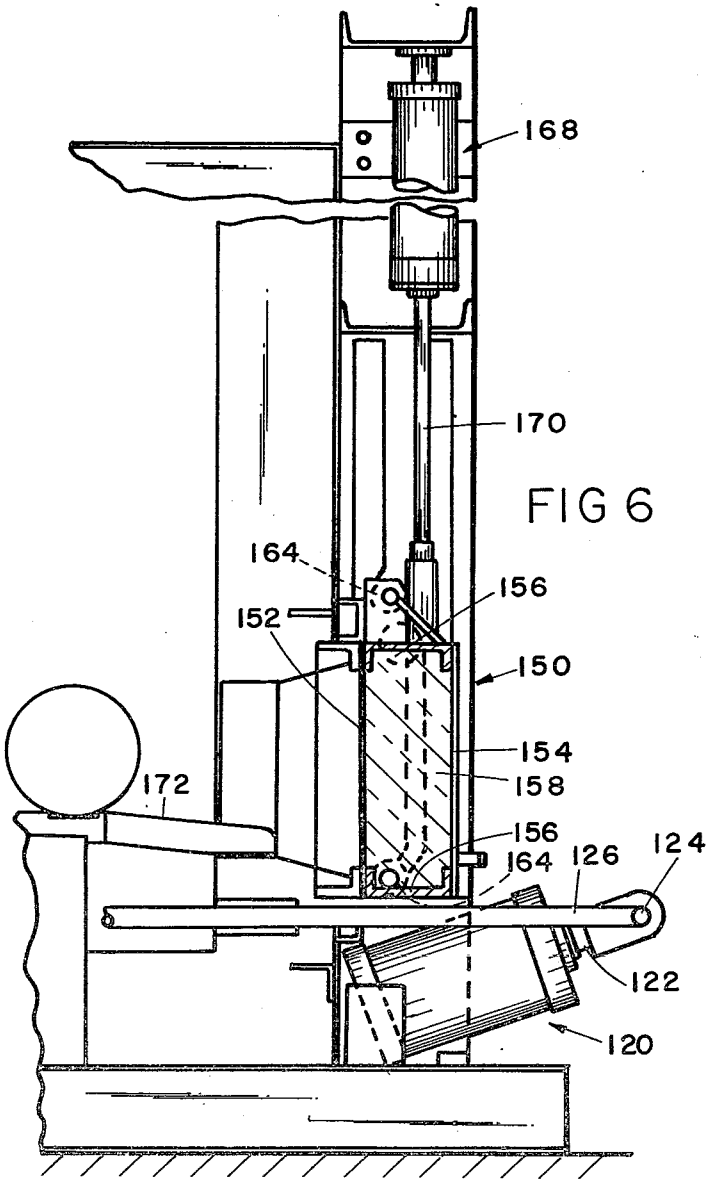
FIG. 6 is an enlarged, fragmentary, side elevational view showing the discharge end of the billet heater.

The pusher bars 86 are reciprocated within the tunnel by a pair of piston/cylinder assemblies 120 disposed at the discharge end of section 14 (FIGS. 4, 6 and 7). The piston/cylinder assemblies 120 each have their piston rods 122 connected to a cross member 124. Each of the rods 86 is connected to the cross bar 124 through intermediate connecting bars 126. The connecting bars 126 are connected at one end to the cross member 124 and adjacent their other ends to respective pusher bars 86 through vertical blocks or plates 128 and sleeves 129. Sleeves 129 are fixedly positioned on the rods 86 yet permit the rods to rotate within the sleeves. As seen in FIG. 5, the connecting bars 126 extend below and parallel to the pusher bars 86 and through the end wall at the discharge end or outlet opening of section 14. Therefore, only the connecting bars 126 extend through the furnace. With prior conveyor systems, substantially more metal extended through the furnace structure which resulted in large thermal losses through conduction. These thermal losses are substantially eliminated.

In use, the bars 86 are rotated so that the lugs 90 extend vertically between each of the billets 32. The piston/cylinder assemblies 120 are then actuated to extend their piston rods 122 and all of the bars 86 will shift to the right when viewed in FIG. 5. The lugs 90 will engage the billets 32 and push the billets 32 into the next adjacent notches 84. As the lugs 90 engage the billets 32 and push them to the next adjacent notches, the billets will roll.

Supporting the rods 86 on the wheels 88, which are rotatably supported by pins 132 extending through the support members 82, permits the bars 86 to rotate relative to the billets and also reciprocate relative to the billets. After the billets have been shifted to the next adjacent notches, the pusher rods 86 are rotated to their second position wherein the lugs 90 are below the billets 32. The piston/cylinders 120 are then actuated so that their rods 122 are retracted and the pusher bars are shifted backwards to their original position ready for another cycle.

Figure 20:
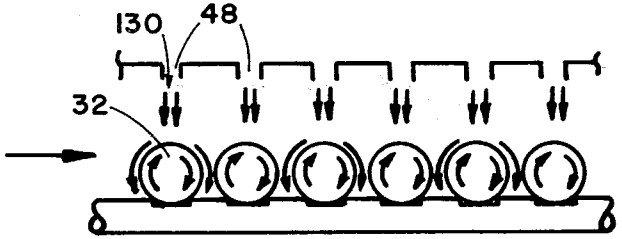
FIG. 20 is a fragmentary, schematic view illustrating a portion of the operation of the heater in accordance with the present invention.

The conveyor shifts and rotates the billets so that they present another portion of their peripheral surfaces for direct impingement by the air jets issuing from the slots 48. This action is illustrated in FIG. 20. As shown therein, air jets 130 issue from the slots 48 and impinge directly on the billets 32 above their longitudinal centerlines. The air jets flow around the cylindrical surfaces presented by the billets. When the pusher bars are actuated to shift the billets on the support bars, the billets will roll as indicated by the arrows to thereby present another portion of their outer peripheral surfaces to direct impingement by the air jets 130. In this manner, substantially uniform heating of the billets is obtained. The rolling action of the billets allows the air jets to cover the entire surface of the billets and insures maximum temperature uniformity. This also results in a decrease in the time period necessary to heat the billets to the required extrusion temperature.

As set forth above, the conveyor assembly incorporated in the present invention substantially reduces the amount of through metal extending from the discharge end of the furnace from that heretofore possible. This structure also permits the use of an insulated door 150 to close off the exit or discharge opening at the end of the tunnel. As seen in FIGS. 6 and 7, the door 150 is of generally rectangular shape and includes an inner plate 152, an outer plate 154 and top and bottom plates 156. Rigid insulation material 158 is disposed between the plates. The door 150 is mounted for vertical movement within guide tracks 160, 162. As seen in FIG. 6, glide wheels 164 are attached to the door structure 150 by suitable brackets and positioned to ride within the respective tracks 160, 162. A cross member 166 is secured to the top of the door 150. A piston/cylinder actuator 168 is supported on the end of the billet heater above the door 150. The piston rod 170 of the actuator 168 is secured to the top of the door 150 at the cross member 166. Through operation of a suitable control system, the piston/cylinder actuator 168 will be actuated to raise the door 150 so that upon shifting of the pusher bars 86, the billet adjacent the discharge opening of a furnace will roll down a ramp 172 (FIG. 6) and be discharged from the furnace.

TEMPERATURE PROBE

Actuation of the pusher bars 86 and the opening and closing action of the exit door 150 is controlled by a system which senses the temperature of the billets to insure that a billet is not discharged unless it is at the required extrusion temperature. The temperature probe 28 at the end of section 12 in conjunction with a conventional control system maintains the temperature in this section at or below a given set point. The probe 28 at the discharge end of the heater senses temperature to control actuation of the conveyor.

The side mounted temperature probes 28 are illustrated in FIGS. 8 and 9. As shown therein, each temperature probe includes a support frame 180 including a horizontal member 182 extending outwardly from and supported by the outer shell of the tunnel. Mounted on the horizontal portion 182 of the support frame 180 is a piston/cylinder actuator 184. The piston/cylinder actuator 184 includes a rod 186 connected to a cross member 188. The ends of the cross member carry rollers or wheels 190. Extending vertically upwardly and connected to the cross member 188 is a bracket member 192. The bracket member carries a probe frame 194. The probe frame includes spaced side members 196 and an end block 198. Mounted adjacent the cylinder of the actuator 184 is a probe support bracket 199. The support bracket 199 includes a pair of vertically spaced, transversely extending bars 201 supporting suitable guides 203. Extending from end block 198 of the probe support frame 194 and into the furnace through the inner and outer shells are elongated, hollow tubes 202. Elongated probes 204 extend through the tubes 202 into the furnace structure. The probes 204 which include sharp, piercing points 206 are electrically insulated from the tubes 202, which are preferably stainless steel, and slide or reciprocate relative to the tubes 202. The probes which are of a conventional nature, are biased into the furnace by a coaxially positioned spring 208. Each spring 208 includes an end abutting a fixed stop 210 extending between side plates 196. The opposite end of the spring 208 abuts stops 212 secured to the probes 204.

Upon retraction of the piston rod 186, the frame 194 will be shifted to the right as viewed in FIGS. 8 and 9. The travel of the rod 186 and the actuator operating pressure is selected so that the piercer points 206 of the probes will engage the ends of the billets 32 and the cylinders 202 will also engage the billets 32. The tubes 202 will shift or push the billets 32 so that they are biased against an inner stop plate 214 as seen in FIGS. 3, 4 and 7. The piercing points 206 of the probes will always remain in contact with the clean sawed end of the billets 32 for accurate temperature sensing and control. The probes stay in contact with the billets except upon actuation of the conveyor means for indexing or moving the billets in the step-like fashion to the next adjacent notches. This biasing of the billets 32 to one side of the conveyor is done so that billets of varying length, for example, 24 inches to 34 inches will always be discharged from the heater with the front face of the billets, as it is presented to a press, in a constant position. This permits efficient heating of various lengths of billets and insures the proper positioning on the billet unloader 26 for presentation at the press. When the tubes 202 are brought into contact with the billets 32, and shift the billets to one side of the conveyor, the probes 206 will contact the clean, sawed surface of the billets an also retract within the tubes 202. Therefore, all shifting force is taken up by the tubes 202.

Side mounting of the temperature probes and contacting of the ends of the billets 32 insures more accurate temperature sensing and control. The probes stay in contact with a sawed surface of the billets and the sensing will not be affected by the oxidation occurring on the peripheral surface of the billet during the heating operation.

BILLET BREAKDOWN TABLE

Figure 17:
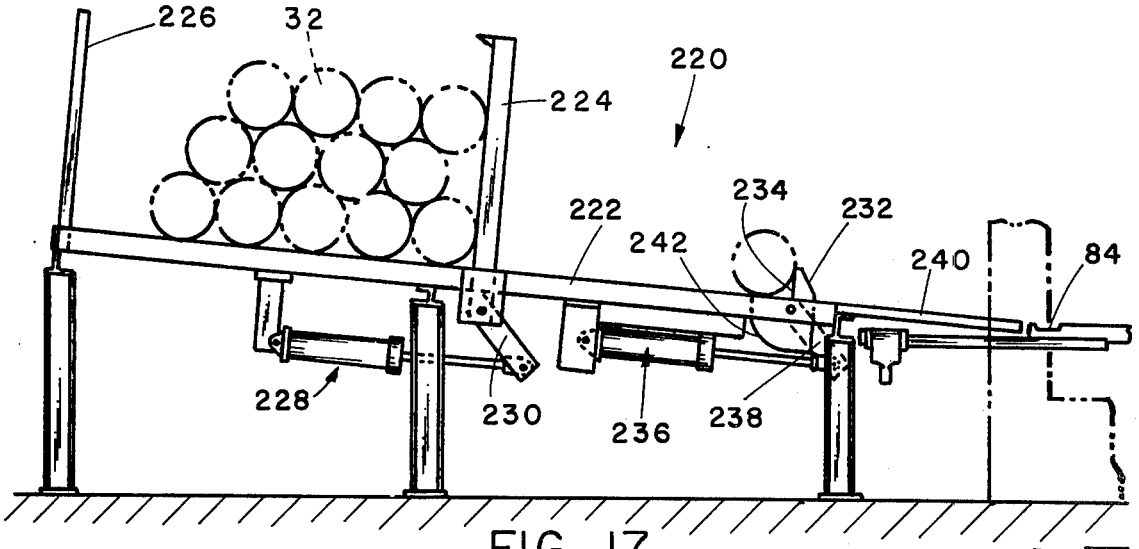
FIG. 17 is a side, elevational view of a billet bundle breakdown and feed table.

The individual billets are supplied to the billet heater at the entrance or inlet end 16 of section 12 by a billet breakdown table 220 illustrated in FIG. 17. The billet breakdown table 220 includes an upper surface defined by rails 222. The billets 32 are positioned on the rails 222 between a pivotally mounted bar 224 and end members 226. The bar 224 is pivotal from the position shown in FIG. 17 to a position parallel with the rails 222 through a piston/cylinder actuator 228 connected to the bar 224 through a link 230. When the bar 224 is rotated downwardly, all of the billets will roll toward the entrance of the heater. The billets are stopped by a pivot member 232. The pivot member 232 defines a generally V-shaped portion 234. A piston/cylinder actuator 236 is connected to the pivot member 232 by a link 238. Rotation of the pivot member 232 permits the billets to enter the furnace down a ramp 240 one at a time. As the member 232 is rotated, one billet is released and edge 242 of the member contacts the next billet and prevents it from rolling down the ramp. The billets 32 roll down the ramp and enter the notches 84 of the support bars 80. After the billet enters the furnace, the pusher bars 86 are actuated to shift the billet to the next adjacent notch providing a space for another billet to enter the furnace.

BILLET UNLOADER

Figure 13:
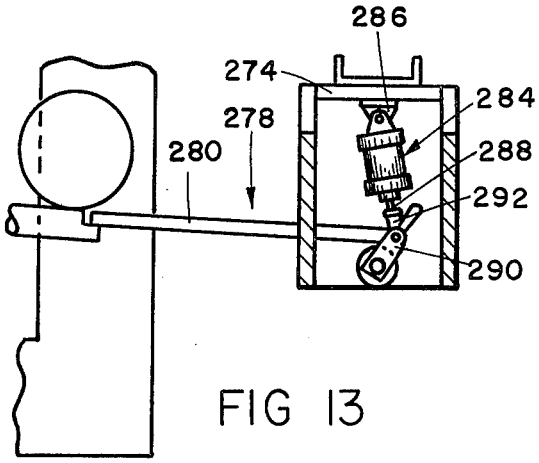
FIG. 13 is a fragmentary, cross-sectional view of the billet unloader taken generally along line XIII—XIII of FIG. 11.
Figure 14:
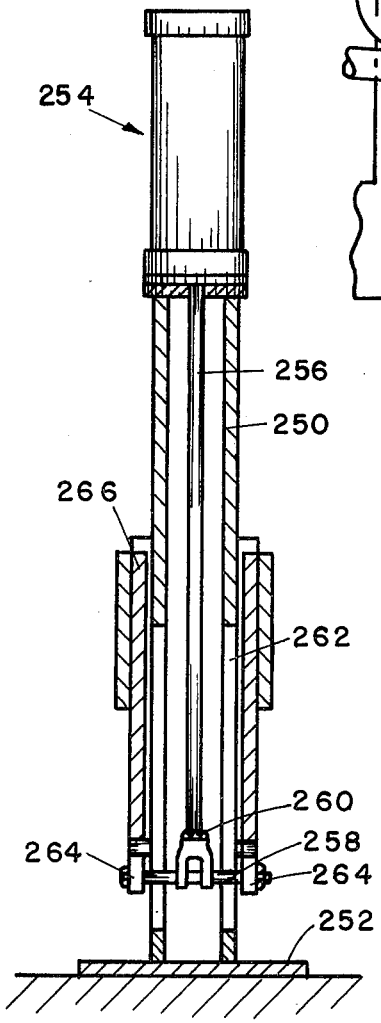
FIG. 14 is a cross-sectional, elevational view taken generally along line XIV—XIV of FIG. 11.
Figure 16:
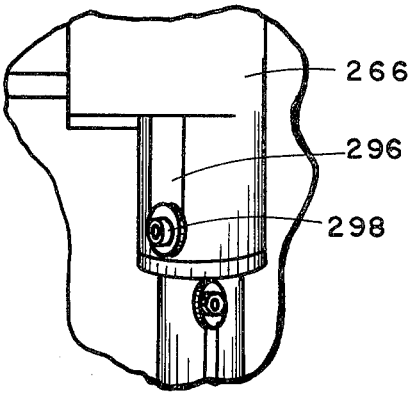
FIG. 16 is a fragmentary, elevational view of the billet unloader.
Figure 11:
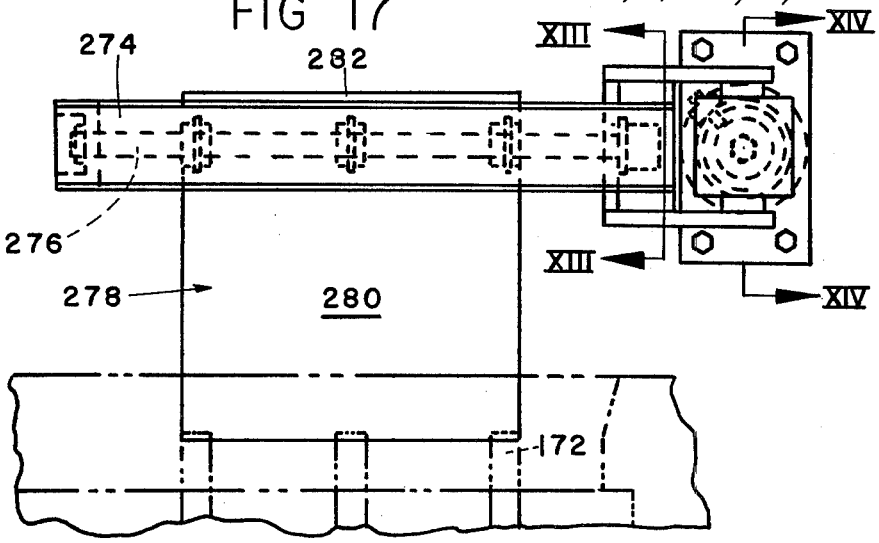
FIG. 11 is a top, plan view of a billet unloader.
Figure 12:
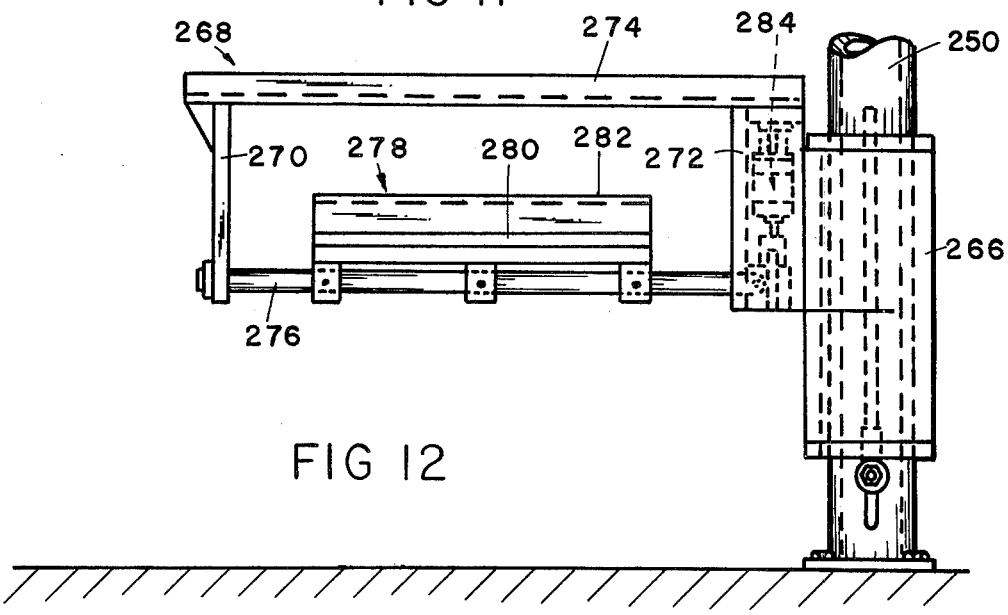
FIG. 12 is a front, elevational view of the billet unloader of FIG. 11.

The billet unloader 26 is illustrated in detail in FIGS. 11–16. As shown in FIGS. 11, 12 and 14, the billet unloader includes the vertically positioned support cylinder 250 disposed on a pad 252. A piston/cylinder actuator 254 is mounted on the top of the support cylinder 250. The rod 256 of the actuator 254 extends downwardly within the support cylinder 250 and is connected to a cross member 258 through a yoke 260. The cross member 258 extends through vertical slots 262 formed in the support cylinder 250. Wheels 264 are rotatably mounted at the ends of the cross member 258. Positioned coaxially with and mounted for vertical movement relative to the support cylinder 250 is an outer cylinder or carrier cylinder 266. The lower end of the cylinder 266 rests on the wheels 264. Therefore, actuation of actuator 254 will result in vertical movement of the outer cylinder 266.

Secured to the outer cylinder 266 and extending radially therefrom adjacent the top thereof is a billet tray, support arm assembly or carrier 268. As seen in FIGS. 11, 12 and 13, the support tray assembly 268 includes frame pieces 270, 272 and 274. Extending between frame pieces or members 270, 272 is a rotatably mounted bar or rod 276. Non-rotatably secured to the rod 276 is a billet support tray or cradle 278. The cradle 278 includes a first, planar surface 280 upon which the discharged billets are received and a second, planar surface 282 angularly related to the surface 280. The second surface 282 serves as a stop when the billets are initially discharged onto the tray 278. A piston/cylinder actuator 284 (FIGS. 12 and 13) is supported from frame member 274. One end of the cylinder of the actuator is pivotally supported by a bracket 286 to frame member 274. The stem 288 is connected to the bar 276 through a link 290. The link 290 is rotatably connected to a yoke 292 carried by the stem or rod 288 and is non-rotatably secured at its other end to the bar 276. Actuation of the piston/cylinder 284 will result in shifting of the tray 278 from a first position, as shown in FIG. 13 where it is substantially horizontal and receives a billet from the discharge end of the furnace to a second position where the billet will roll off the second portion 282 onto a press loader. In moving to the second position, the tray 278 rotates in a clockwise direction as viewed in FIG. 13.

Figure 15:
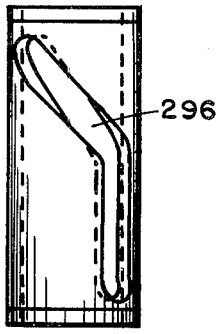
FIG. 15 is an elevational view of an outer cylinder and cam slot employed in the billet unloader.

Since the billets are discharged from the furnace in a position transverse to the furnace, they must be rotated through an angle of 90° and raised for discharge onto the extrusion press. This rotating and raising action is accomplished by providing the outer cylinder 266 with a cam slot 296 as best seen in FIGS. 15 and 15. A cam follower in the form of a roller 298 is fixedly positioned on the support cylinder 250. When the piston rod 256 of actuator 254 is extended, the cylinder 266 will be moved downwardly and rotated through an angle of 90° so that the tray is presented at the discharge ramp 172 of the furnace (FIG. 11). A billet will roll down onto the tray and the actuator 254 will retract the rod 256. As the rod retracts, the outer cylinder 266 is raised and rotated through an angle of 90° to the position shown in phantom in FIG. 1. As a result, the billet will now be positioned with its longitudinal axis in line with the extrusion press. Actuator 284 will then extend its rod 288 rotating the tray 278 so that the billet 32 will roll off the angled planar portion 282 and be fed into the press.

OPERATION

Billets disposed on the billet breakdown table 220, as shown in FIG. 17, are fed individually into the heater and onto the conveyor means 30. Individual billets are conveyed through the furnace in a step-like fashion by actuation of the pusher bars 86. First the bars 86 are rotated so that the lugs extend vertically between adjacent billets. Next, the bars are reciprocated through actuation of the piston/cylinder assemblies 120 and each billet is shifted, pushed and rolled slightly to the next adjacent notch on the support bars 80. Next, the lugs 90 are rotated to their inoperative or retrieval position and the piston/cylinders 120 are again actuated to shift them back into position for the next cycle. The axial fan 66 directs pressurized, high temperature air which has been drawn past the heating elements 18 into the pressure chamber or plenum 40. This high temperature air is discharged from the plenum 40 as high velocity jets through the jet slots 48. The high temperature, convection heated air impinges directly on each billet 32 and passes around the outer surface thereof. The air is then returned to the fan through the duct 70 defined by the inner shell 36 and the plenum 40. The temperature probes 28 contact the clean, sawed ends of each billet and through a suitable control system (not shown) permit actuation of the pusher bars to discharge a heated billet onto the billet unloader 26. The temperature probes control the output of the heating elements 18 so as to heat and maintain the billets at the desired temperature, for example 850° and 900° F. The rolling action of the billets as they are conveyed through the furnace insures substantially uniform heating of the billets and also decreases the time necessary to heat the billets to the desired temperature. The probes 96 remain in contact with the ends of the billets except during indexing of the billets by the conveyor means 30. When it is desired to discharge a billet from the furnace, the temperature of the billet adjacent the discharge opening or exit of the furnace is sensed. If it is at the desired temperature, the door 150 will be raised and the pusher bars sequenced, as described above, to discharge a billet onto the tray 278 of the unloader 26. The unloader is then actuated to raise the billet and rotate it through an angle of 90° and discharge it onto an extrusion press. The control system may be a combined electrical/hydraulic or electrical/pneumatic system.

The operation of the probes including the pusher tubes 202 insures that the billets are transferred to the press delivery point with the front faces of the billets all in a constant position regardless of the length of the billets. By spacing the centers of the notches 82 on the support bars at a distance of 10 inches and by proper dimensioning of the width of the conveyor, billets from 6 to 9 inches in diameter and from 24 to 34 inches in length may be heated for extrusion. The locater notches 84 hold the billets in position and prevent contact between adjacent billets during the heating process. Through proper selection of the fan which may be of a conventional type such as the axial fans sold by Garden City Fan & Blower Co. under the trademark "THERMAL-AIR", by sizing the air foil jet slots 48 so as to achieve a 5,000 ft. velocity and by employing 60 kilowatt heating elements, approximately 75% energy efficiency may be obtained. In heating an 8 inch diameter billet from 70° to 850° F. 187.2 BTU/LB. is the actual energy requirement. Employing a billet heater in accordance with the present invention, the billet may be heated to the desired temperature of 850° F. using 252 BTU/LB. resulting in a 75% efficiency rating. Prior chain flame, impingement type billet heaters have only 10% efficiency and require 1872 BTU/LB. to heat the billet to temperature. Pressure flame, impingement heaters have 20% efficiency and require 936 BTU/LB. Induction heaters have only a 50% efficiency and require 374 BTU/LB. Similarly, a flame heater with recuperation also has a 50% efficiency and requires 374 BTU/LB.

Therefore, it can be seen that the unique billet heater in accordance with the present invention possesses substantial advantages over furnaces heretofore available. The unique conveyor means substantially reduces the amount of through metal extending outside of the furnace area thereby reducing heat losses through conduction and also permitting the employment of an insulated door at the discharge end of the furnace. This also substantially reduces heat loss. The apparatus provides an efficient and relatively rapid furnace for heating billets to the desired extrusion temperature. Substantial increases in production rates per floor area occupied also result. The unique billet heater with the top mounted fans permits it to be readily substituted for existing billet heaters.

While the preferred embodiment of this invention has been illustrated and described, it should now be readily apparent that various modifications could be made without departing from the concepts of the invention disclosed herein. Such modifications are to be considered as included within the hereinafter appended claims, unless these claims by their language expressly state otherwise.

The embodiments of the invention in which an exclusive property or priviledge is claimed are defined as follows:

1. An apparatus for heating billets and the like, comprising:

an elongated, insulated tunnel having an inlet opening at one end wall and an outlet opening at the other end wall;

conveyor means extending through said tunnel from the inlet to the outlet for conveying in a step-like fashion a plurality of spaced billets arranged side-by-side with their long axes transverse to the direction of travel through said tunnel and for rolling said billets as said billets are conveyed in a step-like fashion;

a plenum positioned above said conveyor means and extending substantially the length of said tunnel, said plenum defining a plurality of longitudinally spaced jets positioned above said spaced billets on said conveyor means, each of said jets extending transversely of said tunnel across substantially the entire length of each of said billets; and a source of high temperature, pressurized air communicating with said plenum for delivering high temperature air to said jets for direct impingement on said billets.

2. An apparatus as defined by claim 1 wherein said tunnel has a width greater than said plenum and wherein said source of high temperature air comprises a fan positioned within said tunnel and at least one electrical heating element positioned within said tunnel, said fan drawing air past said heating element to said plenum, the air being continuously recirculated within said tunnel by said fan.

3. An apparatus as defined by claim 2 wherein said jets defined by said plenum comprise elongated slots extending transversely of said tunnel.

4. An apparatus for heating billets as defined by claim 3 further including a plurality of air foil deflector means, each positioned in a corresponding one of said jet slots for directing the high temperature pressurized air downwardly onto said billets.

5. An apparatus for heating billets and the like, comprising:

an elongated, insulated tunnel having an inlet opening at one end wall and an outlet opening at the other end wall;

conveyor means extending through said tunnel from the inlet to the outlet for conveying in a step-like fashion a plurality of spaced billets arranged side-by-side with their long axes transverse to the direction of travel through said tunnel;

a plenum positioned above said conveyor means and extending substantially the length of said tunnel, said plenum defining a plurality of spaced jets positioned above said spaced billets on said conveyor means; and a source of high temperature, pressurized air communicating with said plenum for delivering high temperature air to said jets for impingement on said billets, said conveyor means comprising:

a plurality of support rails extending through said tunnel in generally parallel relationship to each other, each of said support rails including spaced locater notches for receipt of the billets; and billet indexing and rolling means extending through said tunnel adjacent said support rails for indexing said billets along said support rails to the next adjacent locator notches and for rotating said billets as they are indexed in a step-like fashion through said tunnel whereby said billets are substantially uniformly heated within said apparatus.

6. An apparatus for heating billets as defined by claim 5 wherein said billet indexing and rolling means comprises:

a plurality of elongated rods supported adjacent said support rails for reciprocating movement and for at least limited rotary movement;

a plurality of lugs secured to said elongated rods at equally spaced intervals, said lugs extending radially from said rods in the same plane and direction;

means for rotating said rods so that said lugs are moved from a first lug position extending upwardly between said locater notches on said support rails to a second lug position below said notches; and shifting means connected to said rods for shifting said rods from a first rod position to a second rod position towards said tunnel outlet when said lugs are in said first lug position so that billets on said support rails will be shifted to the next locater notches of said support rails and rotated during said shifting and for shifting said rods from said second rod position to said first rod position after said lugs have been moved by said rotating means to their second lug position.

7. An apparatus for heating billets and the like, comprising:

an elongated, insulated tunnel having an inlet opening at one end wall and an outlet opening at the other end wall;

conveyor means extending through said tunnel from the inlet to the outlet for conveying in a step-like fashion a plurality of spaced billets arranged side-by-side with their long axes transverse to the direction of travel through said tunnel;

a plenum positioned above said conveyor means and extending substantially the length of said tunnel, said plenum defining a plurality of spaced jets positioned above said spaced billets on said conveyor means;

a source of high temperature, pressurized air communicating with said plenum for delivering high temperature air to said jets for impingement on said billets, said tunnel having a width greater than said plenum and wherein said source of high temperature air comprises a fan positioned within said tunnel and at least one electrical heating element positioned within said tunnel, said fan drawing air past said heating element to said plenum, the air being continuously recirculated within said tunnel by said fan, said jets defined by said plenum comprising elongated slots extending transversely of said tunnel; and a plurality of air foil deflector means, each positioned in a corresponding one of said jet slots for directing the high temperature pressurized air downwardly onto said billets, said conveyor means comprising:

a plurality of support rails extending through said tunnel in generally parallel relationship to each other, each of said support rails including equally spaced notches for receipt of the billets; and billet indexing and rolling means extending through said tunnel adjacent said support rails for indexing said billets along said support rails to the next adjacent locater notches and for rotating said billets as they are indexed in a step-like fashion through said tunnel wherein said billets are substantially uniformly heated within said apparatus.

8. An apparatus for heating billets as defined by claim 7 wherein said billet indexing and rolling means comprises:

a plurality of elongated rods supported adjacent said support rails for reciprocating movement and for at least limited rotary movement;

a plurality of lugs secured to said elongated rods at equally spaced intervals, said lugs extending radially from said rods in the same plane and direction;

means for rotating said rods so that said lugs are moved from a first lug position extending upwardly between said notches on said support rails to a second lug position below said notches; and shifting means connected to said rods for shifting said rods from a first rod position to a second rod position towards said tunnel outlet when said lugs are in said first lug position so that said billets on said support rails will be shifted to the next locater notches of said support rails and rotated during said shifting and for shifting said rods from said second rod position to said first rod position after said lugs have been moved by said rotating means to their second lug position.

9. An apparatus for heating billets as defined by claim 8 wherein said shifting means comprises:

a plurality of connecting bars, each positioned below one of said rods of said billet indexing means and extending through the end wall of said tunnel below the outlet opening, each of said connecting bars being connected to a corresponding one of said rods within said tunnel;

a cross member joining the ends of said connecting rods exteriorly of said tunnel; and piston/cylinder means positioned outside said tunnel and operatively connected to said cross member for shifting said connecting bars and said rods.

10. An apparatus for heating billets as defined by claim 9 further including an insulated door at said outlet opening and door opening means for shifting said door from a first position closing off said outlet opening to a second position permitting removal of a billet from said outlet opening.

11. An apparatus for heating billets as defined by claim 10 further including billet temperature sensing and biasing means mounted on said tunnel adjacent the outlet opening for sensing the billet temperature at one end face of the billet and for biasing the billet to one side of the conveyor means.

12. An apparatus for heating billets as defined by claim 11 further including billet unloading means at the outlet opening of said tunnel for receiving a billet unloaded from said tunnel, raising the billet and rotating it through an angle of approximately 90°.

13. In a billet heater of the type including an elongated insulated tunnel having an inlet end and an exit end and a source of high temperature gases, an improved billet conveyor means extending within said tunnel for conveying the billets through said tunnel, said improved billet conveyor comprising:

a plurality of elongated support rods extending generally parallel to each other, each of said support rods including spaced locater means for locating a plurality of billets in spaced relationship with their long axes perpendicular to said support rods; and billet pushing means adjacent said elongated support rods for pushing and rolling said billets along said support rods between adjacent locater means in a step-like fashion, said locater means comprising each of said support rods defining upwardly opening notches along their top surfaces, said notches being equally spaced along said support rods and said billet pushing means comprising:

at least one, elongated pusher rod;

means supporting said pusher rod for longitudinal reciprocating movement relative to said support rods and for at least limited rotary movement about the longitudinal axis of said pusher rod; and a plurality of pusher means extending radially from said pusher rod in the same plane, said pusher means being spaced along said pusher rod for engaging said billets and pushing them to the next adjacent notches upon longitudinal movement of said pusher rod.

14. The improvement defined by claim 13 wherein said pusher means comprises:

a plurality of plate-like lugs integral with said support rod.

15. In a billet heater of the type including an elongated insulated tunnel having an inlet end and an exit end a source of high temperature gases, an improved billet conveyor means extending within said tunnel for conveying the billets through said tunnel, said improved billet conveyor comprising:

a plurality of elongated support rods extending generally parallel to each other, each of said support rods including spaced locater means for locating a plurality of billets in spaced relationship with their long axes perpendicular to said support rods; and billet pushing means adjacent said elongated support rods for pushing said billets along said support rods between adjacent locater means in a step-like fashion, said locater means comprising each of said support rods defining upwardly opening notches along their top surfaces, said notches being equally spaced along said support rods, said billet pushing means comprising:

at least one, elongated pusher rod;

means supporting said pusher rod for longitudinal reciprocating movement relative to said support rods and for at least limited rotary movement about the longitudinal axis of said pusher rod; and a plurality of pusher means extending radially from said pusher rod in the same plane, said pusher means being spaced along said pusher rod for engaging said billets and pushing them to the next adjacent notches upon longitudinal movement of said pusher rod, said pusher means comprising:

a plurality of plate-like lugs integral with said support rod, and said billet pushing means further including:

means operatively connected to said pusher rod for shifting said pusher rod longitudinally from a first position wherein said lugs are between said locater notches and a second position, towards the exit end of said tunnel, said lugs engaging said billets and shifting them to the next adjacent locater notches.

16. The improvement defined by claim 15 wherein billet pushing means further includes means for rotating said pusher rod from a first position wherein said lugs extend vertically between said notches to a second position wherein said lugs extend generally horizontally below billets on said support rods.

17. The improvement as defined by claim 16 wherein said pusher rod shifting means comprises:

a piston/cylinder actuator means operatively connected to said pusher bar for shifting said pusher bar between said first and second positions.

18. The improvement as defined by claim 17 wherein said actuator means is operatively connected to said pusher bar by means of a connecting rod positioned below said pusher bar and connected at one end to said actuator and at the other end to said pusher bar.

19. The improvement as defined by claim 18 wherein said pusher rod rotary means comprises:

another piston/cylinder actuator operatively connected to said pusher rod.

20. An apparatus for heating cylindrical billets prior to extrusion including an insulated tunnel, means defining a plurality of spaced, parallel slots extending transversely of said tunnel, a source of high temperature pressurized air communicating with said slots, and an improved conveyor for conveying the billets through said tunnel underneath said slots, said improved conveyor including:

support means for supporting a plurality of billets within said tunnel one beneath each of said slots for direct impingement by an air jet issuing from said slot and extending in a spaced, side-by-side relationship transverse to said tunnel; and means for rolling said billets in a step-like fashion along said support means and between adjacent slots.

21. An apparatus as defined by claim 20 wherein said support means comprises:

a plurality of elongated support rods, each of said rods defining a plurality of spaced notches, each of said billets normally resting in one of said notches of said support rods.

22. An apparatus for heating cylindrical billets prior to extrusion including an insulated tunnel, means defining a plurality of spaced, parallel slots extending transversely of said tunnel, a source of high temperature pressurized air communicating with said slots, and an improved conveyor for conveying the billets through said tunnel underneath said slots, said improved conveyor including:

support means for supporting a plurality of billets within said tunnel one beneath each of said slots and extending in a spaced, side-by-side relationship transverse to said tunnel; and means for rolling said billets in a step-like fashion along said support means, said support means comprising:

a plurality of elongated support rods, each of said rods defining a plurality of spaced notches, each of said billets normally resting in one of said notches of said support rods, and said rolling means comprising:

a plurality of lug means movable from a first position between adjacent billets to a second position below said billets for engaging and rolling said billets to the next adjacent notches when in said first position; and means for moving said lug means into engagement with said billets when said lug means are in said first position and for moving said lug means in the opposite direction when said lug means are in said second position.

* * * * *